United States Patent [19]

Smith

[11] 4,241,783

[45] Dec. 30, 1980

[54] HEATING AND COOLING SYSTEM

[75] Inventor: William A. Smith, Marysville, Ohio

[73] Assignee: Rockwell International Corporation, Pittsburgh, Pa.

[21] Appl. No.: 919,030

[22] Filed: Jun. 26, 1978

[51] Int. Cl.[3] ..... F25B 29/00; F23B 7/00

[52] U.S. Cl. ..... 165/48 R; 165/DIG. 12; 110/234; 62/238 B

[58] Field of Search ..... 165/DIG. 12, DIG. 2, 165/48; 110/233, 234, 210; 62/238 B; 122/20 B

[56] References Cited

U.S. PATENT DOCUMENTS

| | | | |
|---|---|---|---|
| 3,379,146 | 4/1968 | Sluiter | 110/234 |
| 3,844,233 | 10/1974 | Fishback | 110/234 |
| 3,996,862 | 12/1976 | Besik et al. | 110/234 |
| 4,007,776 | 2/1977 | Alkasab | 165/18 |
| 4,070,870 | 1/1978 | Bahel et al. | 62/2 |

FOREIGN PATENT DOCUMENTS

| | | | |
|---|---|---|---|
| 760945 | 3/1934 | France | 62/238 B |

*Primary Examiner*—Albert W. Davis
*Assistant Examiner*—Margaret A. Focarino

[57] ABSTRACT

A heating and cooling system utilizing solid waste for selectively heating and cooling a confined area. The heating and cooling system comprises a pyrolytic incinerator which is capable of combusting the solid waste in an oxygen lean atmosphere. A fan is used to supply outside air to the pyrolytic incinerator to support combustion therein. The fan is also used to exhaust the flue gases through an exhaust system. An afterburner is located in the exhaust duct of the incinerator to allow further combustion of waste gases which have become mixed with the outside air during combustion of the solid waste. A heat exchanger is located in the exhaust duct downstream of the afterburner and transfers the heat of the outside air and waste gas combustion products to heating water passing through the heat exchanger. The heating system portion of the heating and cooling system has a first closed loop piping system selectively connected to the heat exchanger for circulation of the heated water through a radiator in the confined area. Also included is a device for automatically feeding solid waste into the pyrolytic incinerator. The cooling system portion includes a second closed loop piping system which is selectively connected to the heat exchanger and which circulates water through an absorption cold generator. A third closed loop piping system is used to circulate cold water from the absorption cold generator through air conditioners in the confined area to cool air passing therethrough. The absorption cold generator uses the heated water of the second closed loop piping system to produce cooled water for the third closed loop piping system.

2 Claims, 1 Drawing Figure

HEATING AND COOLING SYSTEM

BACKGROUND OF THE INVENTION

1. Field of the Invention.

The present invention relates to a system for heating and cooling a building and, in particular, to a system which utilizes waste material as an energy input for a combined heating and cooling system.

2. Description of the Prior Art.

There has been a long felt need for heating and cooling systems for living and working areas which operate at low cost. To lower costs, it is desirable to utilize fuels costing less than the conventional fossil fuels such as oil, gas and coal.

Heretofore, numerous examples of heating and refrigeration systems utilizing fossil fuels have been disclosed in the prior art. For example, U.S. Pat. No. 3,986,664 issued in 1976 to Gustafsson discloses an oil fired boiler for heating and as a heat pump for cooling a bounded area. U.S. Pat. No. 4,037,649 issued to 1977 to Hartka discloses a combined air-heating and refrigeration system using a conventional furnace using fossil fuel for heating and an absorption refrigeration system for cooling. None of the above cited prior art offer the economy provided by the present invention.

While burning waste material to heat a bounded area using a pyrolytic incinerator is well known in the art, combination thereof with an absorption refrigeration system for summertime cooling has not heretofore been taught in the prior art.

SUMMARY OF THE INVENTION

It is, therefore, an object of this invention to provide an economical heating and cooling system for a bounded area inside a building.

It is an additional object of this invention to provide a heating and cooling system for a bounded area inside a building which utilizes solid waste material as an energy source.

These and other objects of the invention are provided in a preferred embodiment thereof which includes a solid waste system for selectively heating and cooling a confined area. The heating and cooling system comprises a pyrolytic incinerator capable of combusting solid waste. The pyrolytic incinerator includes means for supplying outside air to support the combustion of the solid waste and for exhausting waste gases through an exhaust duct of the incinerator after combustion of the solid waste. An afterburner is located in the exhaust duct of the pyrolytic incinerator and is capable of combusting waste gases which have become mixed with the outside air during combustion of the solid waste thereby further heating the outside air and waste gas combustion products. A heat exchanger is also located in the exhaust duct downstream of the afterburner and is capable of transferring heat from the outside air and waste gas combustion products to heating water passing through the heat exchanger. The heating system portion of the heating and cooling system includes a first closed loop piping system selectively connected to the heat exchanger and is capable of circulating heated water from the heat exchanger through a radiator located in the confined area to transfer heat contained in the heated water to air passing through the radiator. There is also included a device for feeding solid waste into the pyrolytic incinerator. The cooling system portion of the heating and cooling system includes a second closed loop piping system selectively connected to the heat exchanger and capable of circulating the heated water of the heat exchanger through an absorption cold generator. A third closed loop piping system is connected to the absorption cold generator and includes means for circulating cooling water therethrough to supply an air conditioner in the confined area to cool air passing through the air conditioner. The absorption cold generator is capable of employing heat from the heated water supplied by the second closed loop piping system to cool the cooling water of the third closed loop piping system. Thus, the confined area is heated when the second closed loop piping system is isolated from the heat exchanger and is cooled when the first closed loop piping system is isolated from the heat exchanger.

These and other objects of the present invention will become apparent to those skilled in the art by reading the following specification, reference being made to the accompanying drawings, and the appended claims.

BRIEF DESCRIPTION OF THE DRAWING

The description herein makes reference to the sole drawing wherein.

DESCRIPTION OF THE PREFERRED EMBODIMENT

Figure 1:
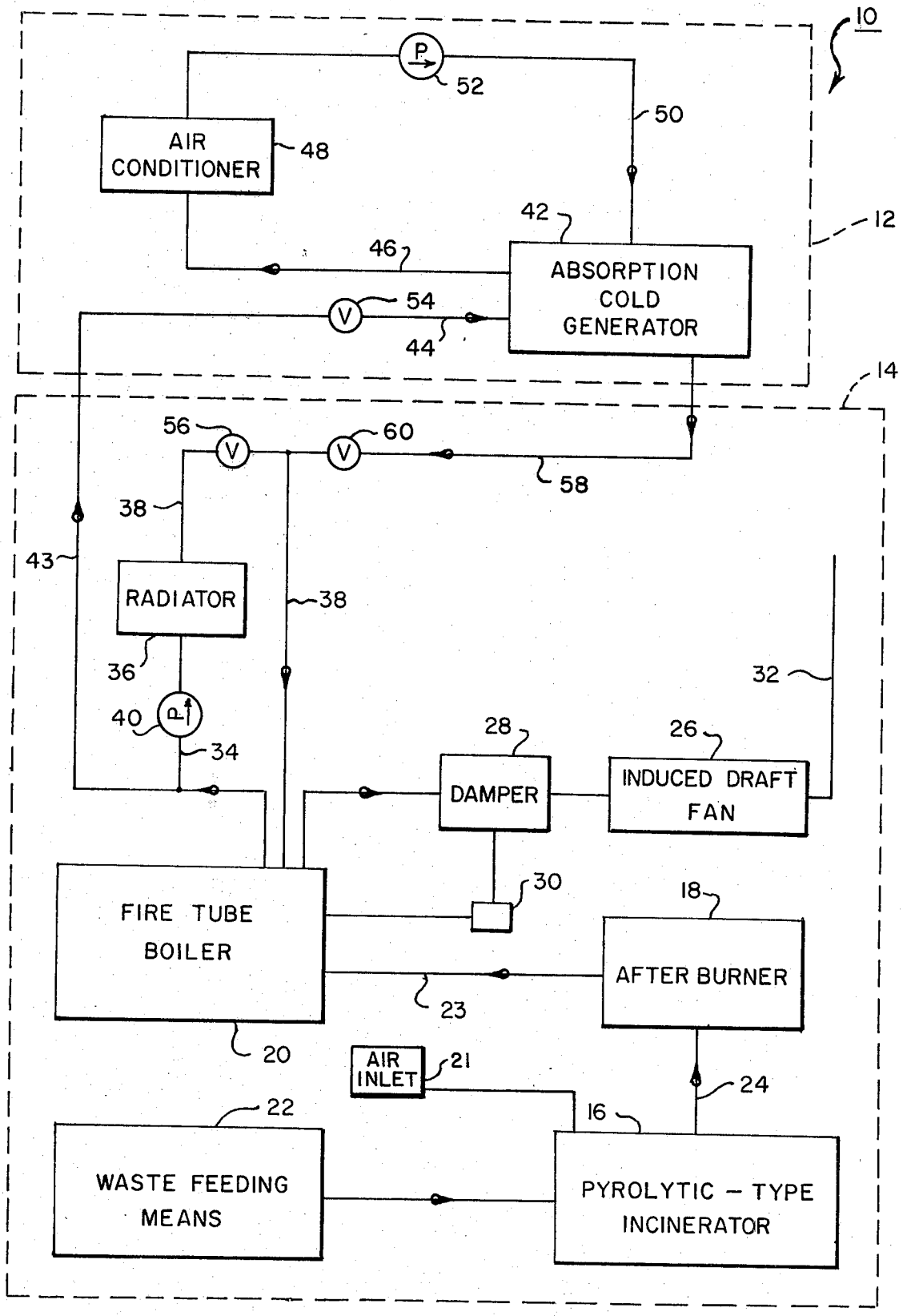
FIG. 1 is a schematic diagram of a combined heating and absorption refrigeration system.

Referring to FIG. 1, there is illustrated a schematic drawing of a combined air, heating and cooling system generally denoted by the numeral 10 comprising an absorption cold generating portion 12 and water heating portion 14. The heating portion 14 comprises a pyrolytic incinerator 16, an afterburner 18 and a heat exchanger 20, all of which are well known in the art. The heat exchanger 20 is for transferring the heat generated by the incinerator 16 to water for heating a confined living or working space (not shown). The pyrolytic incinerator 16 utilizes solid waste to produce heat by the thermal degradation of the solid waste in an atmosphere which is low in oxygen. The solid waste and air are fed into the pyrolytic incinerator 16 through a waste feeding system 22 and an air inlet 21. The burning of the waste material in a low oxygen atmosphere produces volatile flue gases. The production of volatile flue gases is achieved by combination of the solid waste in about one-third of the stiochiometric amount of air required for combustion thereby resulting in high combustion temperatures. These high temperatures cause gasification of the volatile compounds in the solid waste. The feeding means 22 feeds the solid waste into the incinerator in a manner which limits the amount of air going into the combustion chamber thereby preserving the oxygen lean combustion atmosphere.

In the preferred embodiment the volatile flue gases are carried by a flue gas duct 24 to the afterburner 18. The afterburner 18 provides for combustion of the gasified wastes leaving the pyrolytic incinerator 16 thus generating a high temperature combination of air and combustion products waste gas. The afterburner 18 accomplishes this further combustion of the gases produced by the pyrolytic incinerator by adding air and igniting this gaseous mixture with a natural gas pilot (not shown). Air is added to the afterburner 18 until at least 150% stiochiometric air is achieved. This excess oxygen insures complete combustion of all volatile gases so that the effluent waste gas combustion products from the heating system are clean.

Recovery of heat from the flue gases is accomplished by any standard tube shell heat exchanger 20 located downstream of the afterburner 18. In the preferred embodiment a three pass horizontal fire-tube type boiler which has water flowing over the tubes is used. Hot waste gases are carried by a waste gas duct 23 directly through the tubes of the preferred boiler 20 from the afterburner 18.

In the preferred embodiment the boiler or heat exchanger 20 is equipped with an induced draft fan 26 to direct the flue gases through the boiler. The fan 26 draws the gases from the pyrolytic incinerator 16 through the thermal reactor 18 and into the boiler 20. The fan 26 includes a modulated damper 28 on the fan inlet to control the amount of hot waste gases passing through the boiler 20. The flue gases pass through the boiler thereby generating hot water for heating and cooling as described hereinbelow. The position of the modulated damper 28 is regulated in accordance with the demand for hot water. In the preferred embodiment a high temperature limit switch 30 is provided to deactivate the induced draft fan 26 should, for any reason, the normal temperature operating range of the boiler 20 be exceeded. After the hot waste gases leave the induced draft fan 26, they are exhausted to the atmosphere through an exhaust stack 32.

A first closed loop piping system 34 is connected to the boiler 20 for transporting hot water to a plurality of radiators 36 located throughout the confined living or working area. The piping system 34 includes a return line 38 which returns the water to the boiler 20. The piping system 34 further includes a pump 40 which circulates the heated water from the boiler 20 and returns the water from the raditors 36 to the boiler.

In the preferred embodiment the cooling portion 12 of the system comprises an absorption cold generator 42 which utilizes the hot water output of the boiler 20 to produce a refrigerant vapor for cooling water therein. Absorption cold generators are well known in the art and have been generally described in U.S. Pat. No. 4,037,649 issued in 1977 to Hartka.

A second closed loop piping system 43 is included in the cooling portion 12 of the system. The second closed loop piping system 43 connects the boiler 20 with the absorption cold generator 42. This closed loop piping system 43 includes a hot water input line 44 which can selectively carry heated water from the boiler 20 to the absorption cold generator 42.

A third closed loop piping system 46 is used to transport the cold water output of the absorption cold generator 42 to air conditioners 48 located throughout the confined living or working area. The piping system 46 includes a cold water return line 50 which returns the water from the air conditioners 48 to the absorption cold generator. The piping system 46 includes a pump 52 circulating the cooled water throughout the closed circuit described above.

The absorption cold generator is designed to employ heat from the heated water of the second closed loop piping system 43 to cool the cooling water of the third closed loop piping system 46. The absorption cold generator includes a pump (not shown) to circulate the heated water through the second closed loop piping system.

The hot water input line 44 to the absorption cold generator 42 includes a valve 54 to selectively connect or disconnect the absorption cold generator 42 from the hot water output of the boiler 20 when the cooling of the living or working area is or is not desired.

In the preferred embodiment an isolation valve 56 is provided for isolating the radiators 36 from the boiler 20 when the cooling system is running. If cooling is desired, valve 56 is closed and valve 54 is opened to connect the hot water output of the boiler 20 to the hot water input line 44 of the absorption cold generator 42. In other words, the first closed loop piping system 34 is isolated from the boiler and the second closed loop piping system 43 by valve 54.

The hot water used by the absorption cold generator 42 is returned to the boiler 20 by a return line 58. The return line 58 can be isolated from the boiler by valve 60 to prevent hot water from flowing into the absorption cold generator 42 when it is not in use.

It is to be noted that in the preferred embodiment hot water is used to carry heat into the living or working area and for operating the absorption cold generator 42, however, steam could also be used with equal ease. It can be seen that the present invention has provided a new and improved system for heating and cooling a confined living or working space which is of a more efficient design and thus more economical to operate than devices heretofore known.

While only one example of the present invention has been described, it should be understood to those skilled in the art of air, heating and refrigeration systems that other forms may be added without departing from the spirit of the present invention or the scope of the appended claims. Therefore, without limitation in this respect, the invention is defined in the following claims.

I claim:

1. A heating and cooling system utilizing solid waste for selectively heating and cooling a confined area, said heating and cooling system comprising:

a pyrolytic incinerator capable of combusting said solid waste, means for supplying outside air to said pyrolytic incinerator to support combustion of said solid waste in a low oxygen atmosphere and for exhausting through an exhaust duct of said pyrolytic incinerator after said combustion of said solid waste;

an afterburner in said exhaust duct of said pyrolytic incinerator capable of combusting waste gases which have become mixed with said outside air during combustion of said solid waste to further heat said outside air and waste gas combustion products;

a heat exchanger in said exhaust duct downstream of said afterburner capable of transferring heat of said outside air and said waste gas combustion products to heating water passing through said heat exchanger;

a heating system portion including a first closed loop piping system selectively connected to said heat exchanger and capable of circulating said heated water of said heat exchanger through a radiator in said confined area to transfer the heat contained in said heated water to air passing through said radiator;

means for feeding said solid waste into said pyrolytic incinerator;

a cooling system portion including a second closed loop piping system selectively connected to said heat exchanger and capable of circulating said heated water of said heat exchanger through an absorption cold generator;

a third closed loop piping system connected to said absorption cold generator including means for circulating cooling water therethrough to supply an air conditioner in said confined area to cool air passing through said air conditioner; and said absorption cold generator capable of employing heat from said heated water of said second closed loop piping system to cool said cooling water of said third closed loop piping system; whereby said confined area is heated when said second closed loop piping system is isolated from said heat exchanger and is cooled when said first closed loop piping system is isolated from said heat exchanger.

2. A heating and cooling system as set forth in claim 1, wherein the means for supplying outside air further comprises a damper to regulate the amount of said heated outside air and said waste gas combustion products passing through said heat exchanger thereby limiting the heat transferred to said first or said second closed loop piping system.

* * * * *

UNITED STATES PATENT AND TRADEMARK OFFICE

CERTIFICATE OF CORRECTION

PATENT NO. : 4,241,783

DATED : December 30, 1980

INVENTOR(S) : William A. Smith

It is certified that error appears in the above-identified patent and that said Letters Patent are hereby corrected as shown below:

Column 1, line 21, delete "4,037,649" and insert --4,037,644--; also in line 21, delete "to", first occurrence, and insert --in--.

Column 3, line 36, delete "raditors" and insert --radiators--; and in line 58, after "52" insert --for--.

Signed and Sealed this

Second Day of February 1982

[SEAL]

Attest:

GERALD J. MOSSINGHOFF

Attesting Officer

Commissioner of Patents and Trademarks